US008220656B2

(12) United States Patent
Seehoff

(10) Patent No.: US 8,220,656 B2
(45) Date of Patent: Jul. 17, 2012

(54) ORGANIZER SYSTEM

(75) Inventor: Gary S. Seehoff, Encino, CA (US)

(73) Assignee: Evriholder Products, LLC, Anaheim, CA (US)

( * ) Notice: Subject to any disclaimer, the term of this patent is extended or adjusted under 35 U.S.C. 154(b) by 1004 days.

(21) Appl. No.: 11/953,775

(22) Filed: Dec. 10, 2007

(65) Prior Publication Data

US 2009/0145914 A1 Jun. 11, 2009

(51) Int. Cl.
*B65D 6/00* (2006.01)

(52) U.S. Cl. ..... 220/676; 206/375; 206/755; 206/735

(58) Field of Classification Search ..... 220/676, 220/755, 476, 480, 720, 729, 735; 206/77.1, 206/375, 372, 294
See application file for complete search history.

(56) References Cited

U.S. PATENT DOCUMENTS 892,969 A * 7/1908 Wilson ..... 220/524
2,124,071 A * 7/1938 Loftin ..... 312/199
2,278,850 A * 4/1942 Hammond ..... 217/62
2,710,983 A * 6/1955 Abrams et al. ..... 15/265
3,618,749 A * 11/1971 Vaccaro ..... 220/507
4,899,968 A * 2/1990 Eaglin et al. ..... 248/131
D309,066 S * 7/1990 Foran et al. ..... D6/466
5,039,046 A * 8/1991 Brewster ..... 248/206.3
5,086,940 A * 2/1992 Parker et al. ..... 220/214
5,294,163 A * 3/1994 Lang ..... 294/161
D346,682 S * 5/1994 Trovato ..... D3/308
D358,484 S * 5/1995 Cautereels et al. ..... D3/310
D358,691 S * 5/1995 Engle ..... D32/54
5,414,892 A * 5/1995 Clark, Jr. ..... 15/263
D372,614 S * 8/1996 Falke et al. ..... D6/520
5,579,915 A * 12/1996 Liss ..... 206/554
5,702,140 A * 12/1997 Radja ..... 294/146
5,941,410 A * 8/1999 Mangano ..... 220/735
6,039,205 A * 3/2000 Flink ..... 220/659
6,059,109 A * 5/2000 Stein ..... 206/373
6,082,573 A * 7/2000 Hofman et al. ..... 220/480
D474,891 S * 5/2003 Huang ..... D3/309
6,662,940 B1 * 12/2003 Kowal ..... 206/77.1
6,745,895 B2 * 6/2004 Silvers ..... 206/233
6,823,992 B2 * 11/2004 Redzisz ..... 206/373
7,067,737 B2 * 6/2006 Mallen ..... 174/66
D541,531 S * 5/2007 Leao ..... D3/308
D543,730 S * 6/2007 Bonaventura ..... D6/475
7,243,793 B2 * 7/2007 Ho ..... 206/373
7,290,651 B2 * 11/2007 Irwin et al. ..... 206/216
7,314,134 B2 * 1/2008 Redzisz ..... 206/373
7,575,117 B2 * 8/2009 Redzisz et al. ..... 206/373
7,588,277 B2 * 9/2009 Crown ..... 294/146
7,604,103 B2 * 10/2009 Hamlin ..... 190/111
7,641,835 B2 * 1/2010 Ramsey et al. ..... 264/260
7,780,036 B2 * 8/2010 Splain et al. ..... 220/774
2002/0179462 A1 * 12/2002 Silvers ..... 206/233
2005/0167306 A1 * 8/2005 Ho ..... 206/373
2005/0211707 A1 * 9/2005 Mak et al. ..... 220/23.86
2006/0027469 A1 * 2/2006 Irwin et al. ..... 206/216
2006/0037881 A1 * 2/2006 Redzisz et al. ..... 206/373

(Continued)

*Primary Examiner* — Anthony Stashick
*Assistant Examiner* — Christopher McKinley

(57) ABSTRACT

An organizer is presented including a front portion including a bag compartment, a rear portion is connected to the front portion with a hand grip and a first side portion and a second portion each connected to the front portion and the rear portion. The first side portion and the second side portion each including a number of slots each adapted to connect to a holder having a slide portion. The bag compartment includes an opening surrounded with a soft and flexible material.

17 Claims, 9 Drawing Sheets

U.S. PATENT DOCUMENTS

2006/0102638 A1* 5/2006 Summerfield ..... 220/755
2007/0138191 A1* 6/2007 LeGreve ..... 220/755
2007/0295723 A1* 12/2007 Mak et al. ..... 220/23.86
2009/0008281 A1* 1/2009 Williams et al. ..... 206/373

* cited by examiner

ORGANIZER SYSTEM

BACKGROUND

1. Field

This invention relates to cleaning organizers, and more particularly to an organizer system including a bag compartment.

2. Description of the Related Art

With a plethora of kitchen and bathroom products on the market, organization of these products is increasingly necessary. Further, with many large households, people duplicate products throughout the many rooms, including bathrooms, kitchen, playroom, etc. Without duplicate products, people must carry all the products to the different rooms where they may be needed.

Further, many people re-use plastic grocery or shopping bags for small trash bags. These bags can end up in drawers or separate storage devices that are stationary.

The problem then arises from having to carry many products and bags throughout a person's dwelling or business.

SUMMARY

An organizer includes a front portion with a storage portion, a rear portion is connected to the front portion with a handle. A first side portion and a second portion are each connected to the front portion and the rear portion. The first side portion and the second side portion each include a number of slots. A bottom plate is connected to the front portion, the rear portion, the first side portion and the second side portion. The plurality of slots are each adapted to removably connect with a hook component.

Another embodiment presented is an organizer system including a front portion including a bag compartment, a rear portion is connected to the front portion with a hand grip and a first side portion and a second portion each connected to the front portion and the rear portion. The first side portion and the second side portion each including a number of slots each adapted to connect to a holder having a slide portion. The bag compartment includes an opening surrounded with a soft and flexible material.

BRIEF DESCRIPTION OF THE DRAWINGS

The embodiments are illustrated by way of example, and not by way of limitation, in the Figures of the accompanying drawings and in which like reference numerals refer to similar elements and in which.

DETAILED DESCRIPTION

The invention generally relates to an organizer system. Referring to the figures, exemplary embodiments of the invention will now be described. The exemplary embodiments are provided to illustrate the invention and should not be construed as limiting the scope of the invention.

Figure 1:
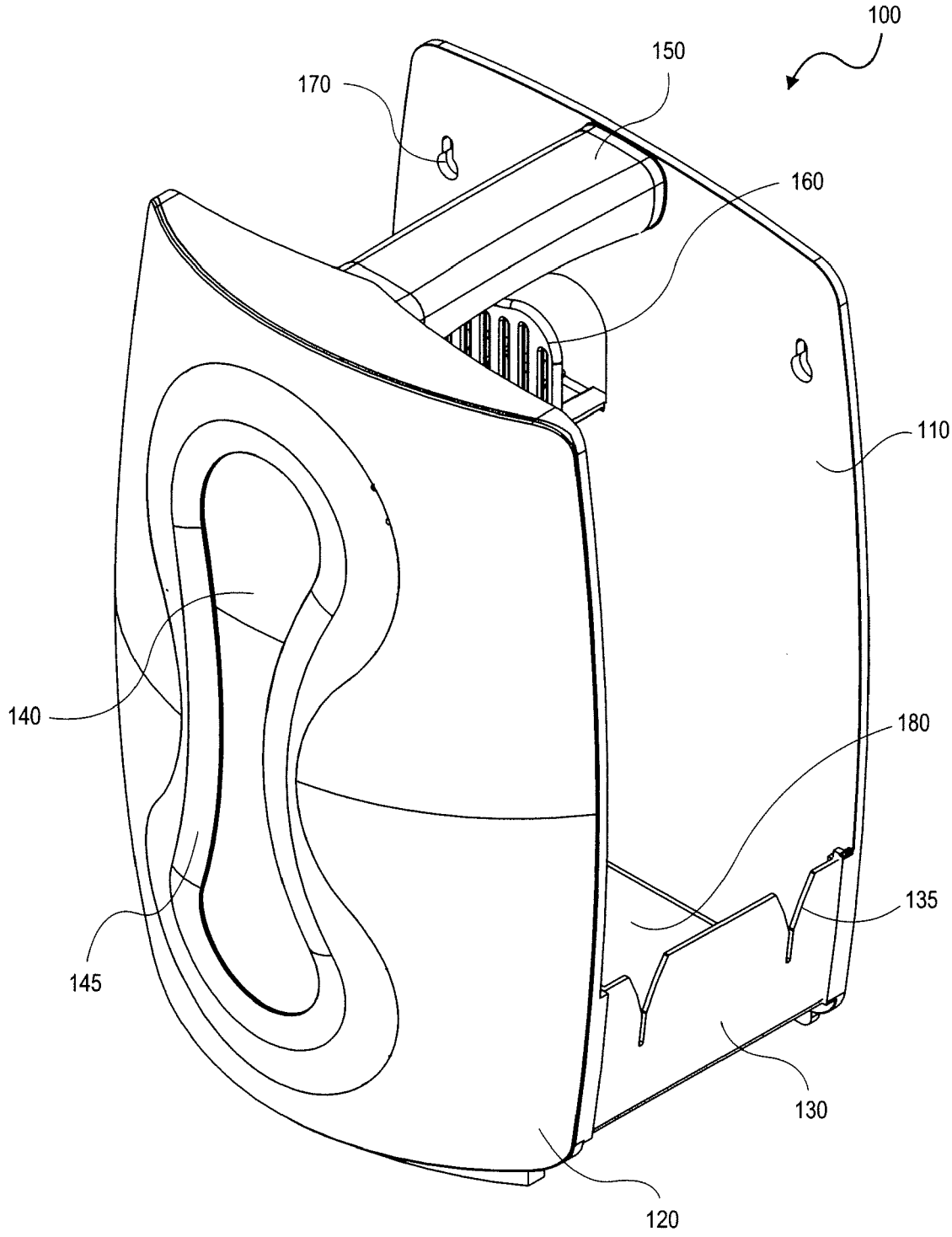
FIG. 1 illustrates a perspective view of an embodiment of an organizer.

FIG. 1 illustrates an embodiment of an organizer and storage unit 100 having a rear or back wall portion 110, a front portion 120, right side wall portion 130 and a handle or grip portion 150. When assembled, the components form a storage area 180 where various kitchen, bathroom, garage, etc. products can be stored. In one embodiment, right side wall portion 130 includes v-shaped slots 135. One should note that while two v-shaped slots are illustrated in FIG. 1, other embodiments can have more or less v-shaped slots 135. In one embodiment handle 150 includes a handle core right portion, a handle core left portion and an over-molded portion.

In one embodiment, the over-molded portion of handle 150 includes a gripping portion. The gripping portion can be made with a ridge or raised texture throughout its length in order to accommodate a better gripping surface for a user. In another embodiment, the gripping portion includes a gripping material, such as rubber, foam rubber, silicon rubber, etc., that is coupled to the exterior surface of handle 150. The gripping material provides additional gripping ease to a user, even when the gripping material is wet or is used with a cleaning solvent, such as liquid detergent. In these embodiments, the gripping portion can be indented or contoured to ergonomically fit to a user's hand.

In one embodiment, rear wall 110 includes a holder 160. In one embodiment, holder 160 includes a number of channels or slots. Holder 160 is adapted to hold various items, such as sponges, soap, rags or dish cloths, etc. In one embodiment, holder 160 is integral with rear wall 110. The channels or slots allow air to enter/leave for freshness and drying purposes and allows water to drain out. In other embodiments, holder 160 is removable from rear wall 110. In embodiments where holder 160 is removable from rear wall 110, holder 160 can be snapped in place, slid onto rear wall 110 or fastened by other known techniques.

In one embodiment, rear wall 110 includes many openings 170 that allow organizer and storage unit 100 to be fixed or removably fixed to a fixture, such as a wall, door, furnishing, etc. Therefore, organizer and storage unit 100 can be fixed or portable.

As illustrated in FIG. 1, front portion 120 includes a compartment 140 having a soft and smooth portion 145 that covers the perimeter of the opening of compartment 140. Compartment 140 allows for storage of items, such as plastic grocery bags, cleaning cloths, etc. The soft and smooth portion allows a person to enter their hand into compartment 140 without the possibility of being scratched or injured, and without snagging or catching plastic bags on a hard edge. The narrow portion of the opening of compartment 140 allows items, such as plastic grocery bags, etc., to be held in place so that they do not fall out of compartment 140.

Figure 2:
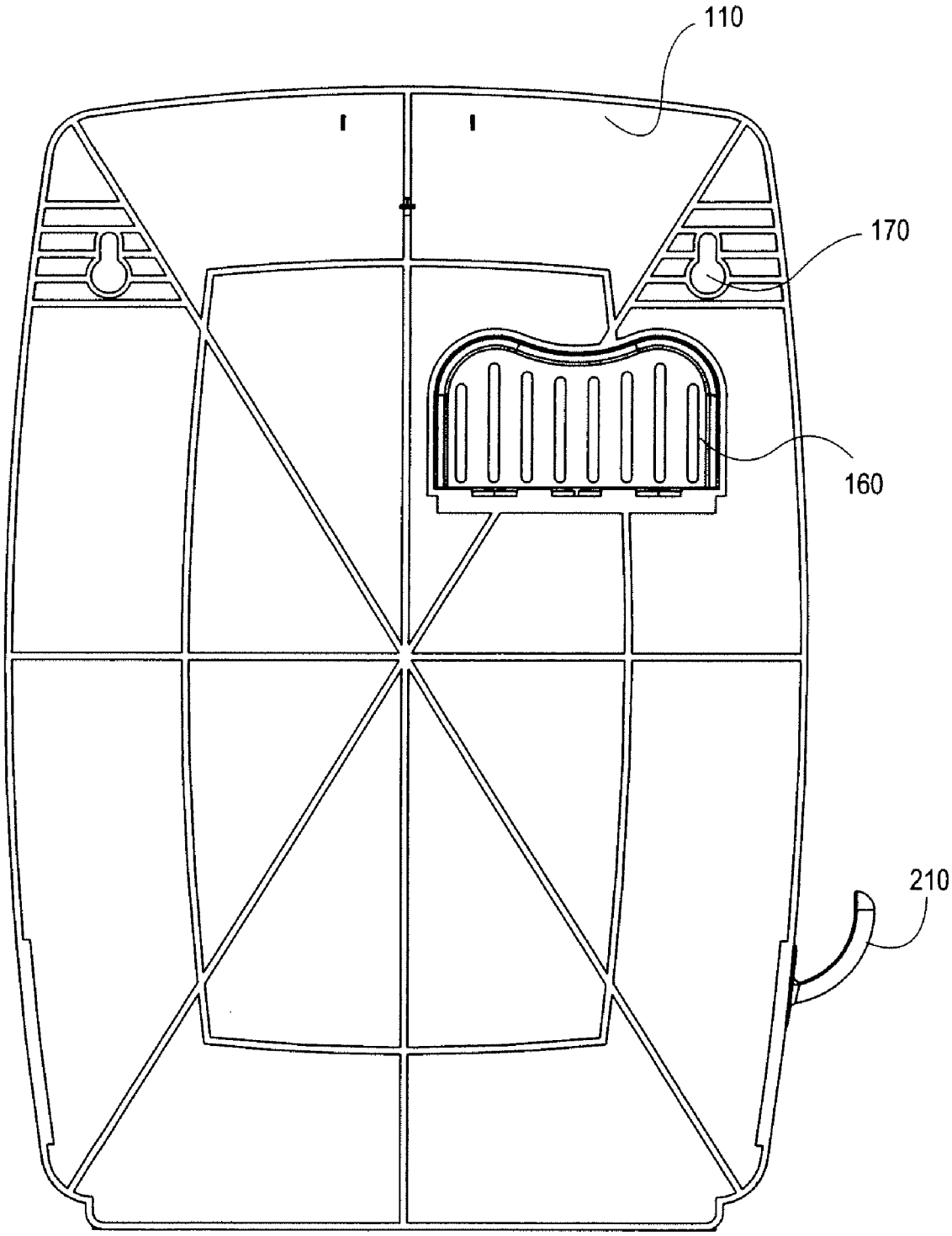
FIG. 2 illustrates a rear view of the organizer illustrated in FIG. 1.
Figure 3:
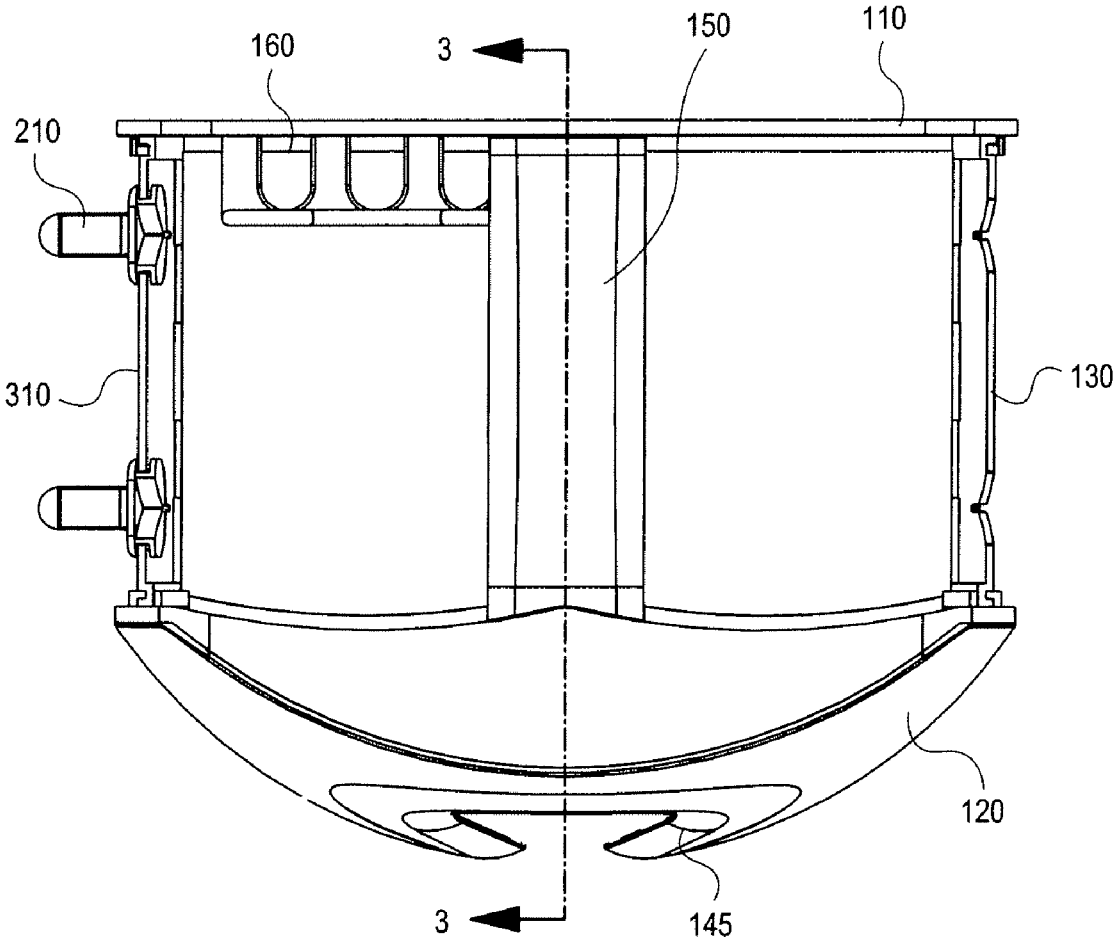
FIG. 3 illustrates a top view of the organizer illustrated in FIG. 1.

FIG. 2 illustrates a rear view of rear wall 110. As illustrated, a hook portion 210 is inserted into a v-shaped slot 135. FIG. 3 illustrates a top view of organizer and storage unit 100. Reference numeral 3 shows the center of organizer and storage unit 100 from front portion 120 to rear wall 110. Left side wall portion 310 is illustrated with hook portions 210 inserted into v-shaped slots 135.

Figure 4:
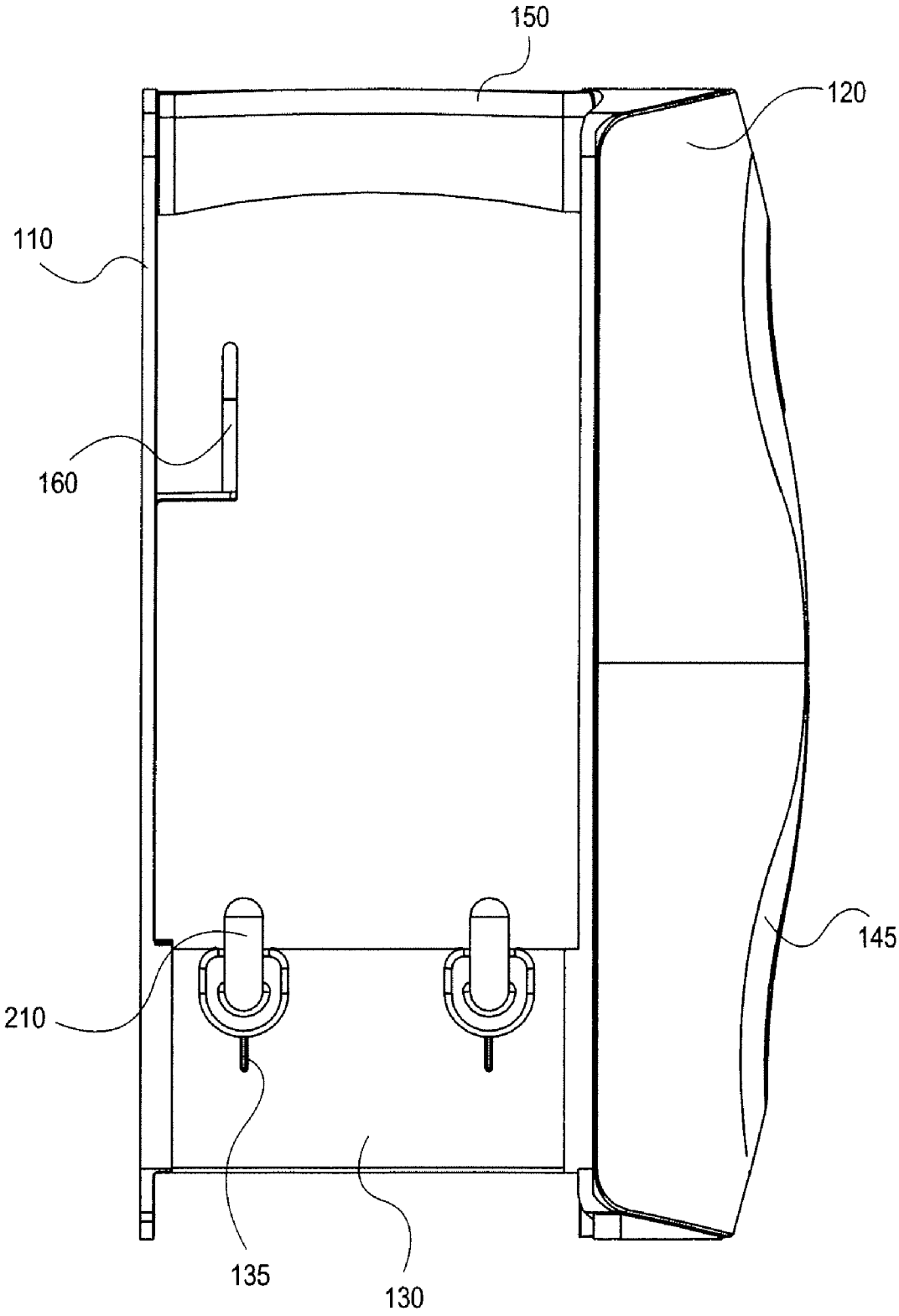
FIG. 4 illustrates a left side view of the organizer illustrated in FIG. 1.
Figure 5:
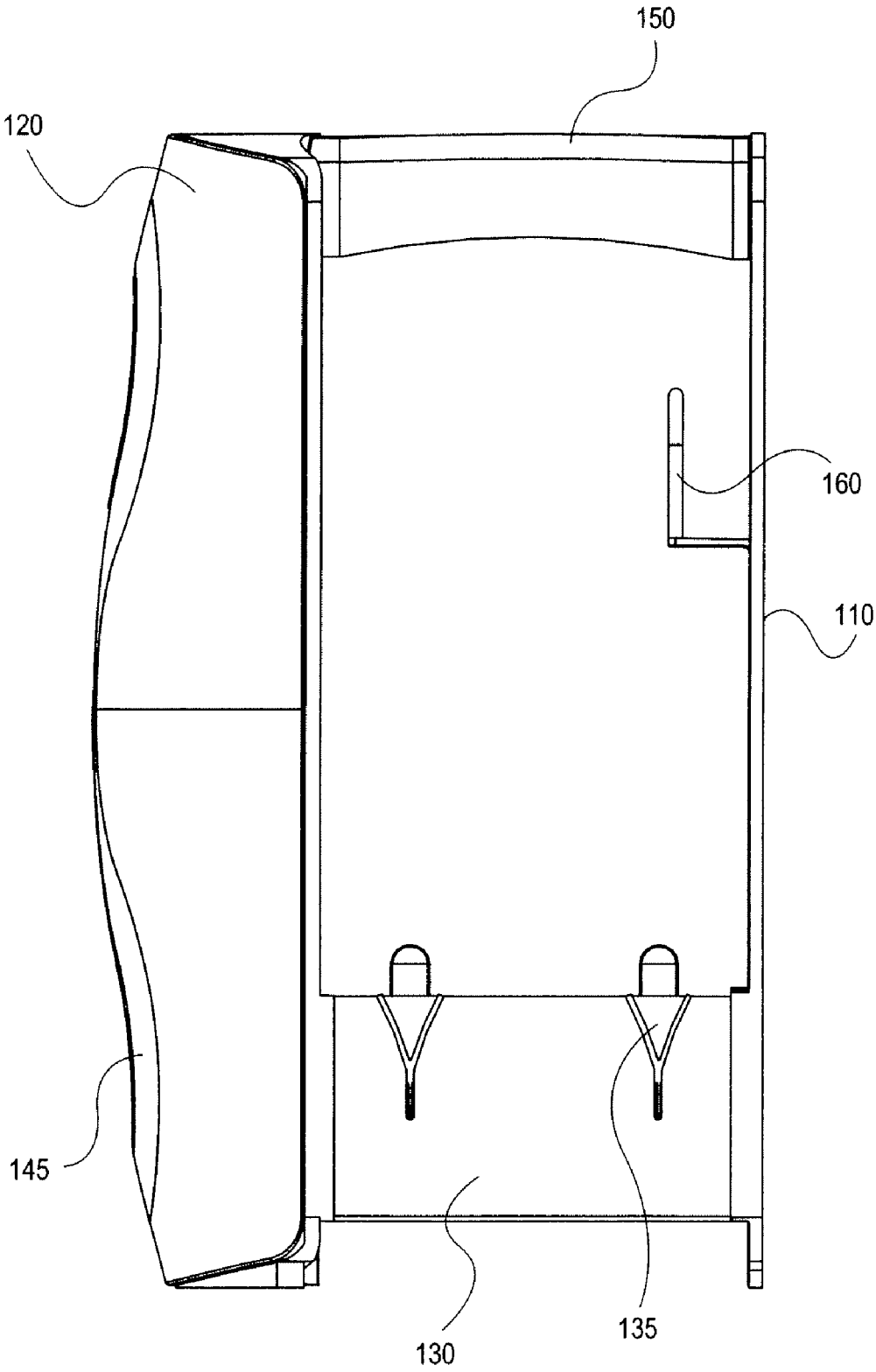
FIG. 5 illustrates a right side view of the organizer illustrated in FIG. 1.
Figure 6:
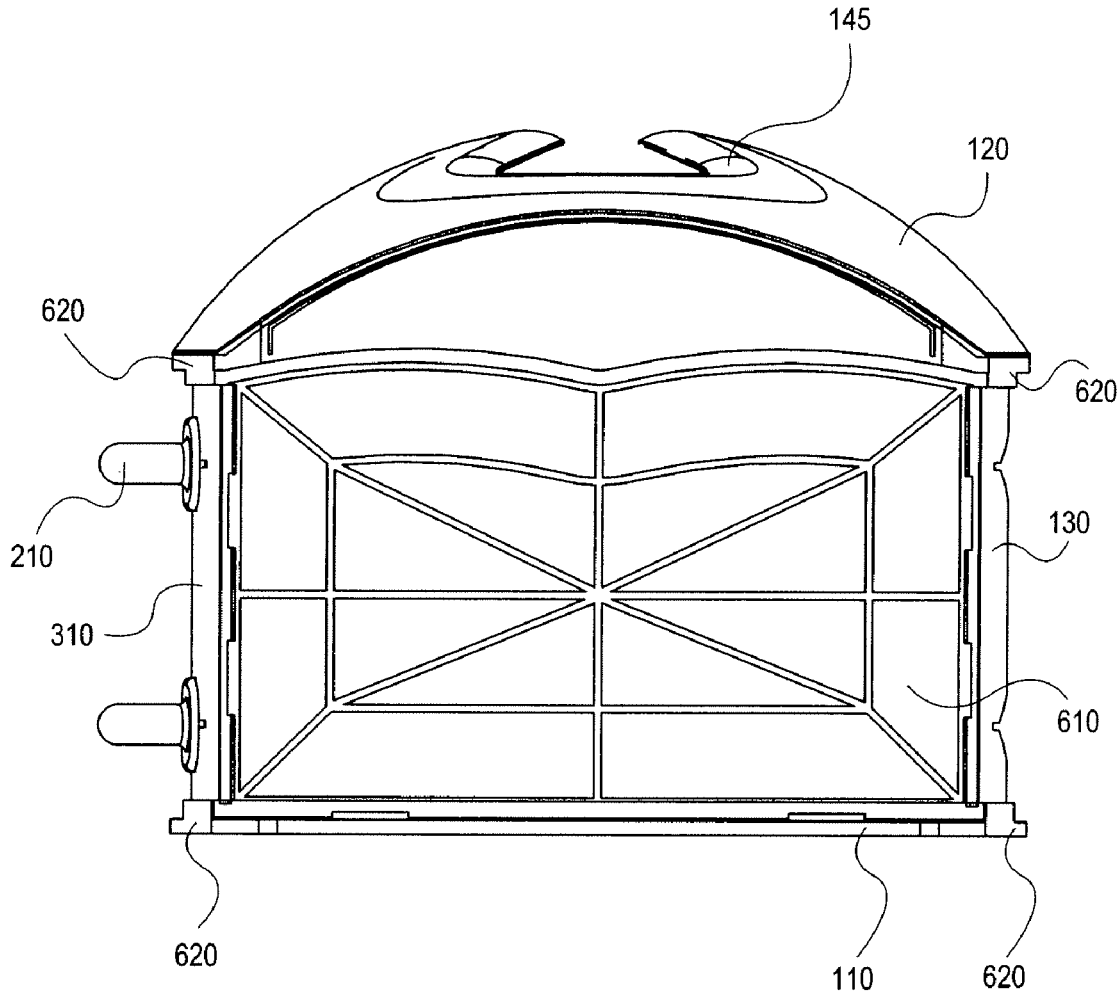
FIG. 6 illustrates a bottom view of the organizer illustrated in FIG. 1.

FIG. 4 illustrates a left side view of organizer and storage unit 100. FIG. 5 illustrates a left side view of organizer and storage unit 100. FIG. 6 illustrates a bottom view with organizer and storage unit 100 lying on its rear wall 110. Bottom 610 is illustrated with raised footing portions 620. In one embodiment footing portions 620 have a rubber element inserted within footing portion 620 such that a portion remains outside of footing portions 620. In this embodiment, footing portions 620 including the rubber element act to prevent movement of organizer and storage unit 100 between foot portions 620 (and rubber elements) and a surface. In another embodiment, footing portions 620 are solid without a rubber element. Footing portions 620 can be made of any non-slip material suitable for a footing. In the above embodiments, footing portions 620 create a space between a solid surface and bottom 610.

Figure 7:
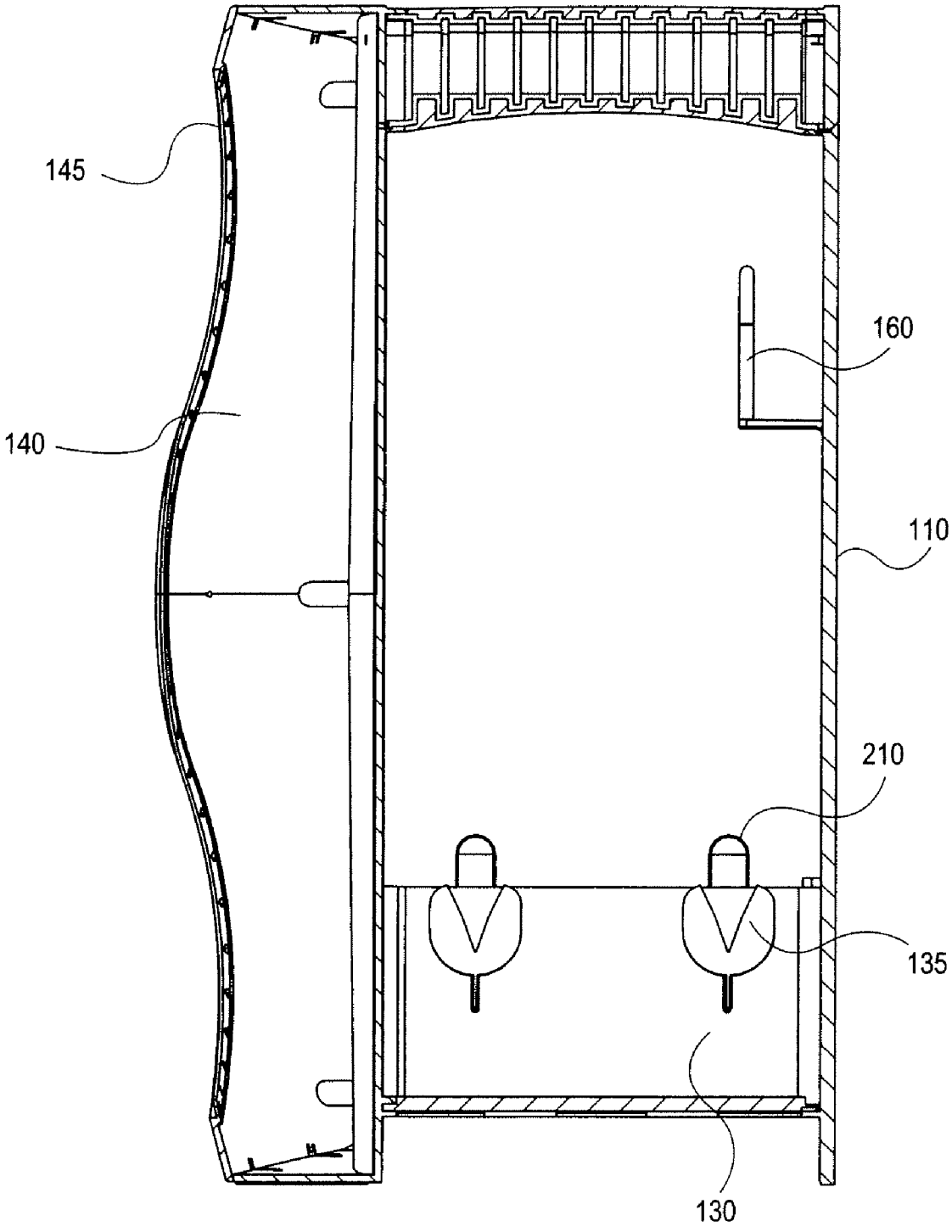
FIG. 7 illustrates a cut-away view of the organizer illustrated in FIG. 1.

FIG. 7 illustrates a cut-away view of organizer and storage unit 100. In one embodiment, once manufacturing is completed, the components are supplied assembled or disassembled, in which case they are be packaged in a disassembled form to be assembled by a user. The design and configuration of the components are made in a way that allows for packing the components into a smaller footprint package and gives the consumer the ability to assemble organizer and storage unit 100 themselves"

In one embodiment A method of assembling that allows the consumer to assemble organizer and storage unit 100 in a few steps. In this embodiment first handle sub-core and the Overmolded rubber handle 150 are positioned and secured into place via snap hook and pocket into the predetermined location onto rear wall 110. Next bottom 610 is positioned into a slot. The slot is located in a predetermined position and corresponds with the length, width and depth of an insertion tab on bottom 610 when attached.

Next the user places front portion 120 with compartment 140 and aligns handle 150 sub-core and the bottom 610 within similar receptacles as on the aforementioned bottom 610 to secure front portion 120. Then the user slides the side walls (130 and 310) into place engaging slide locks 900 (see FIG. 9) provided on rear wall 110 and the back of the pre-assembled front portion 120 including cavity 140.

Next slide locks 900 are engaged, and the user then secures the side walls 130 and 310 by pushing them down towards bottom 610 and engaging the snap hooks that bind organizer and storage unit 100 together. Lastly, the user then places hook portions 210 in the available v-shaped slots 135 located on the side walls 130 and 310 to secure the hooks into the desired hook positions.

Figure 8:
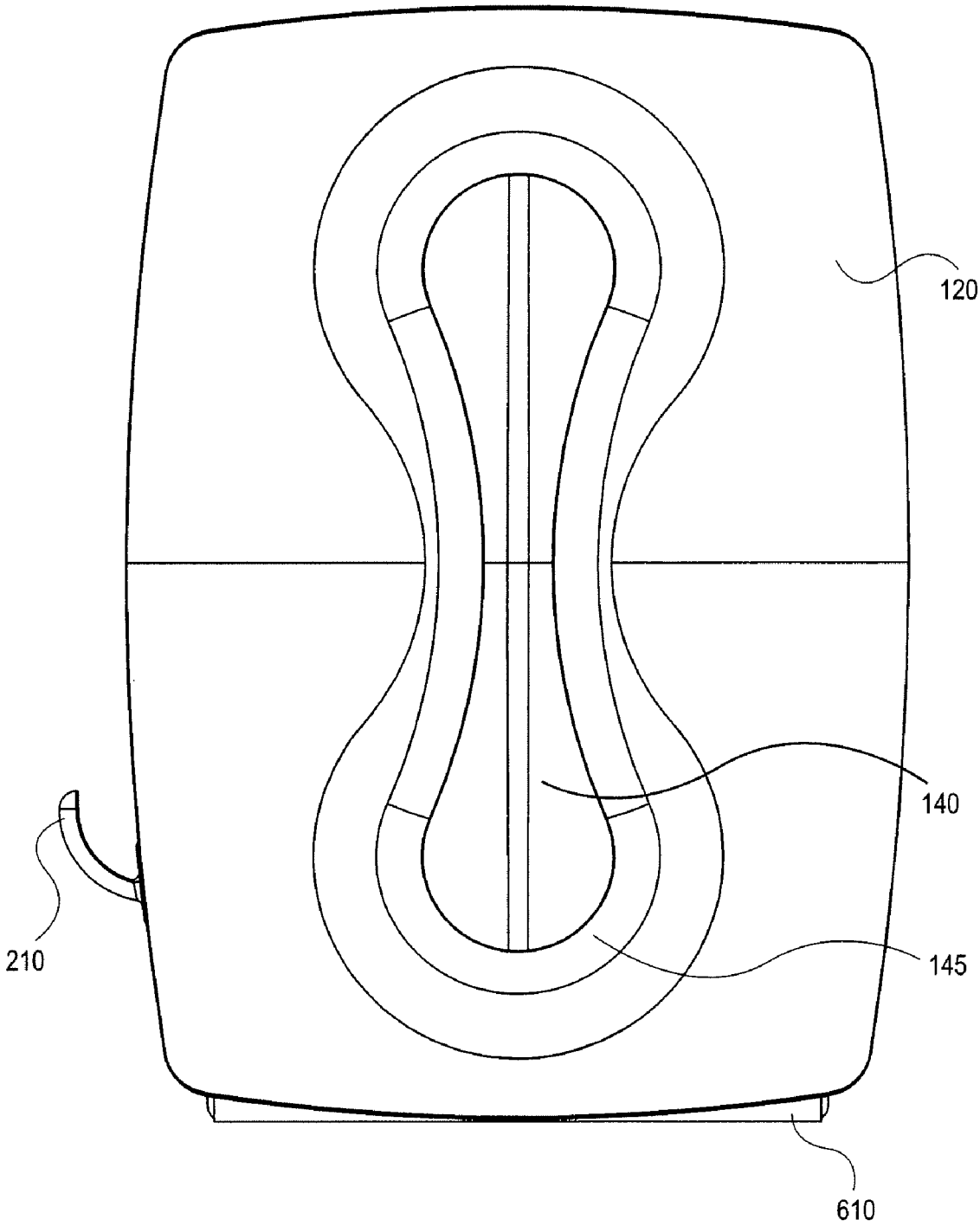
FIG. 8 illustrates a front view of the organizer illustrated in FIG. 1.

FIG. 8 illustrates a front view of organizer and storage unit 100.

In one embodiment organizer and storage unit 100 is manufactured using injection molded plastic. In one embodiment, handle 150 and soft and smooth portion 145 are made with a combination of TPR (thermal plastic rubber). The TPR is introduced as a co-molded aspect of handle 150 and soft and smooth portion 145. In other embodiments, organizer and storage unit 100 is made of fiberglass, wood, metal, casting resin, epoxy resin, paper/cardboard, stone, concrete, ceramics.

Besides injection molding, in other embodiment organizer and storage unit 100 is made from other processes or techniques, such as lay-up molding (fiberglass), metal casting, metal machining, clay or ceramic casting (Slip casting), forging, high pressure paper or laminate forming, carving(wood), plastic sheet thermo-forming fabrication, resin casting (epoxy or urethane), injection molded plastic without TPR co-molded components, etc. The various components of organizer and storage unit 100 can each be made of different materials. It should also be noted that organizer and storage unit 100 can be made by hand, use robotics or a combination of both.

It should also be noted that organizer and storage unit 100 can be made in various sizes so that many different sized products may be stored in storage area 180, e.g., cleaning products, paper towels, etc. The size of organizer and storage unit 100 can be adapted depending on desired use organizer and storage unit 100. Organizer and storage unit 100 can also be sized to ergonomically fit users having a different hand or glove size, i.e. handle 150 can be varied in size.

Figure 9:
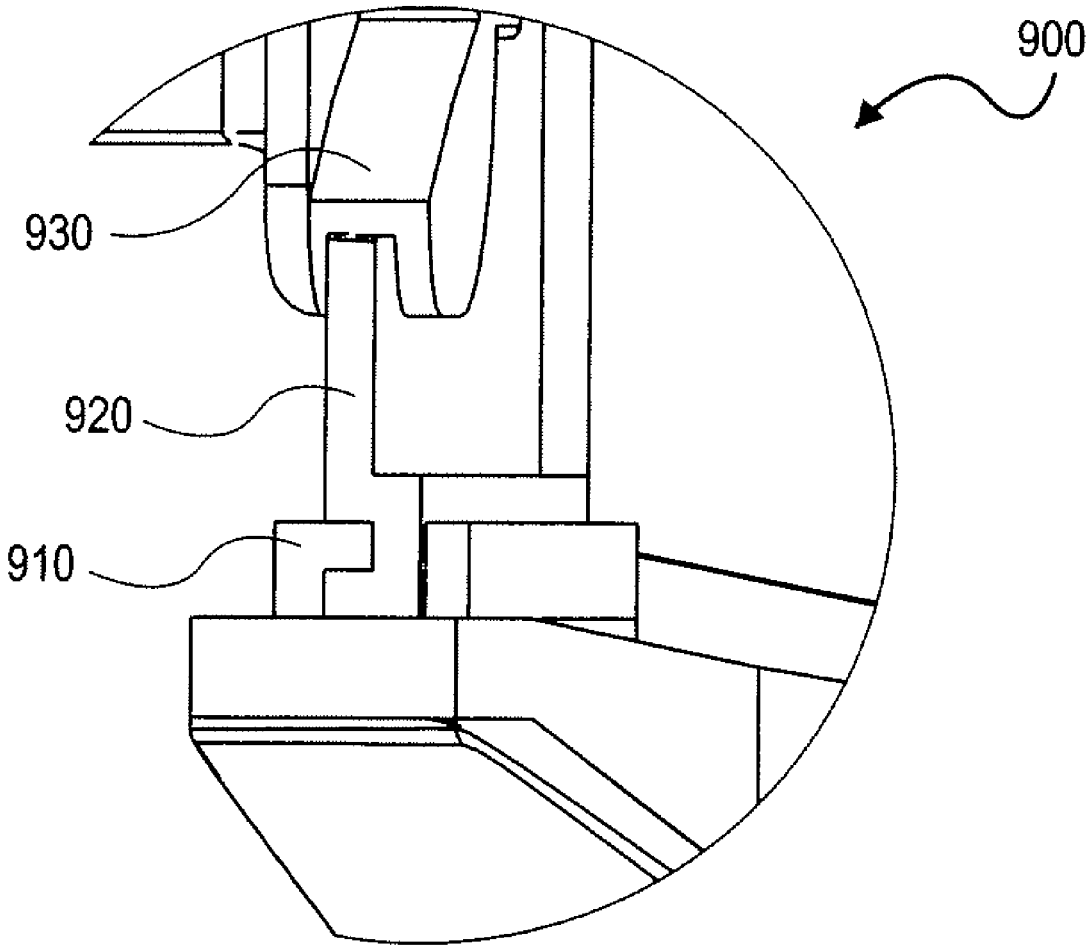
FIG. 9 illustrates a close-up view of a slide lock component o of the organizer illustrated in FIG. 1.

FIG. 9 illustrates details of slide lock 900. Slide lock 900 includes different portions of all the components that slide and lock together. In one embodiment, lower locking portion 910 and upper locking portion 930 complementarily fit middle locking portion 920 so that the various components are locked in place when assembled. The fitting of the different locking portions is such that the different locking portions snap into place. In one embodiment, a locking tab connected to middle locking portion 920 fits and locks into place middle locking portion and lower locking portion.

Organizer and storage unit 100 can fit in an aesthetic environment with ease and be functional and immediately accessible. Organizer and storage unit 100 makes it easy to move multiple items typically stored in separate areas (e.g., kitchen, rooms, bathrooms, garage, etc.) so that duplicate items are unnecessary.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. An organizer comprising:

a front portion including a storage portion, wherein the storage portion including an opening;

a rear portion coupled to the front portion with a handle;

a first side portion and a second side portion each coupled to the front portion and the rear portion, the first side portion and the second side portion each including a plurality of slots; and a bottom plate coupled to the front portion, the rear portion, the first side portion and the second side portion, wherein each of the plurality of slots is removably coupled with a hook component, wherein the opening having a perimeter entirely surrounded by a soft and flexible material, the opening includes a first wide hand opening portion, a second wide hand opening portion and a narrow portion located between the first wide hand opening portion and the second wide hand opening portion, and the opening comprises an integral perimeter disposed on the front portion.

2. The organizer of claim 1, wherein the storage portion including a wall portion, and a compartment is formed between the opening and the wall portion.

3. The organizer of claim 2, wherein the compartment stores plastic bags.

4. The organizer of claim 1, wherein a holder is coupled to the rear portion.

5. The organizer of claim 4, wherein the holder includes a plurality of channels.

6. The organizer of claim 1, wherein the rear portion includes a plurality of openings, wherein the organizer is removably coupled to a fixture through the plurality of openings.

7. The organizer of claim 1, wherein the front portion, the rear portion, the first side portion and the second side portion are coupled together with a plurality of locking channels.

8. The organizer of claim 1, wherein each of the plurality of slots is v-shaped, and the hook component is sized to hold a key ring.

9. An organizer system comprising:

a front portion including a bag compartment, wherein the bag compartment including an opening;

a rear portion coupled to the front portion with a hand grip; and a first side portion and a second side portion each coupled to the front portion and the rear portion, the first side portion and the second side portion each including a plurality of slots each removably coupled to a hook including a slide portion, wherein the bag compartment including an opening having a perimeter entirely surrounded with a soft and flexible material, the opening having a first wide opening portion, a second wide opening portion and a narrow portion located between the first wide opening portion and the second wide opening portion, and the opening comprises an integral perimeter.

10. The organizer system of claim 9, wherein the bag compartment is adapted to store a plurality of plastic shopping bags.

11. The organizer system of claim 9, wherein a sponge holder is coupled to the rear portion.

12. The organizer system of claim 9, wherein a soap holder is coupled to the rear portion.

13. The organizer system of claim 9, wherein the rear portion includes a plurality of attachment slots, wherein the organizer is removably coupled to a fixture through the plurality of attachment slots.

14. The organizer system of claim 9, wherein the front portion, the rear portion, the first side portion and the second side portion are assembled together with a plurality of locking channels.

15. The organizer system of claim 9, wherein the soft flexible material is thermal plastic rubber.

16. The organizer system of claim 9, wherein the hand grip is over-molded with thermal plastic rubber.

17. The organizer system of claim 9, further comprising a bottom plate coupled to the front portion, the rear portion, the first side portion and the second side portion.

* * * * *